US006196304B1

(12) United States Patent
Schwarz

(10) Patent No.: US 6,196,304 B1
(45) Date of Patent: Mar. 6, 2001

(54) TUBE-BLOCK-TYPE HEAT TRANSFER DEVICE AND METHOD OF MAKING SAME

(75) Inventor: Gebhard Schwarz, Stuttgart (DE)

(73) Assignee: Behr GmbH & Co., Stuttgart (DE)

( * ) Notice: Subject to any disclaimer, the term of this patent is extended or adjusted under 35 U.S.C. 154(b) by 0 days.

(21) Appl. No.: 08/917,909

(22) Filed: Aug. 27, 1997

(30) Foreign Application Priority Data

Aug. 31, 1996 (DE) ..... 196 35 457

(51) Int. Cl.[7] ..... F28D 1/053; F28F 9/00

(52) U.S. Cl. ..... 165/140; 165/153; 165/916; 165/11.1

(58) Field of Search ..... 165/140, 153, 165/167, 76, 11.1

(56) References Cited

U.S. PATENT DOCUMENTS

| | | | |
|---|---|---|---|
| 4,099,928 | 7/1978 | Norback . | |
| 4,327,802 | 5/1982 | Beldam | 165/153 |
| 4,893,673 | 1/1990 | Rosman et al. | 165/167 |
| 5,180,004 | 1/1993 | Nguyen | 165/140 |
| 5,462,113 | 10/1995 | Wand | 165/167 |
| 5,638,900 | 6/1997 | Lowenstein et al. | 165/168 |

FOREIGN PATENT DOCUMENTS

| | | |
|---|---|---|
| 3810131C1 | 7/1989 | (DE) . |
| 4031577A1 | 4/1992 | (DE) . |
| 4437877A1 | 4/1996 | (DE) . |
| 0479012A1 | 4/1992 | (EP) . |

OTHER PUBLICATIONS

Search Report, Feb. 3, 1997, Germany.

*Primary Examiner*—Allen Flanigan
(74) *Attorney, Agent, or Firm*—Evenson McKeown Edwards & Lenahan PLLC

(57) ABSTRACT

A tube-block-type heat transfer device has a tube block consisting of several tubes arranged side-by-side, having spacing elements which are inserted between two adjacent flat tube end areas respectively, and have in each case at least one connection duct along each transverse side of the tube block. The tubes are sealed off on the end side and are provided with transverse openings in their two end areas, which transverse openings are in a connection-duct-forming connection with spacing element transverse openings. At least one pair of separation spacing elements 5*a*, 5*b* situated opposite one another in the same space between two tubes have a closed construction so that, on each transverse side of the tube block, at least two mutually separated connection ducts is are formed so that several fluids can flow separately through pertaining tube block sections. The heat transfer device is especially useable as an oil/air cooler for motor vehicles for cooling engine and transmission oil.

15 Claims, 2 Drawing Sheets

TUBE-BLOCK-TYPE HEAT TRANSFER DEVICE AND METHOD OF MAKING SAME

BACKGROUND AND SUMMARY OF THE INVENTION

This application claims the priority of German Patent No. 196 35 457.9, the disclosure of which is expressly incorporated by reference herein.

The invention relates to a tube-block-type heat transfer device having a plurality of tubes arranged in a row, side by side, in the transverse direction. Heat transfer devices of this type are used, for example, in a flat-tube construction, as oil/air coolers or as water/air coolers in motor vehicles. In this type of application, the fluid to be cooled flows from a connection duct operating as the distributor duct on a transverse side of the tube block through the tubes to a connection duct operating as a collecting duct on the other transverse side of the tube block and is cooled by air blown through between the tubes. For improving the heat transfer, a rib structure is usually inserted into the spaces between the tubes.

A tube-block-type heat transfer device is described, for example, in European Published Patent Application EP 0 479 012 A1. There, the flat tubes are spaced by means of one intermediate bottom or supporting ridge respectively on each transverse side of the tube block. In this case, the tubes extend through passage openings in the intermediate bottoms or the support ridges and lead on an open end side into laterally connecting, box-shaped connection ducts used as the distributor or collecting duct.

The invention is based on the technical problem of providing a tube-block-type heat transfer device of the initially mentioned type which is comparatively easy to manufacture and has at least two fluid circulations which are separated from one another.

The invention solves this problem by providing a tube-block-type heat transfer device having a tube block consisting of several tubes which are arranged in a row in the transverse direction side-by-side in a spaced manner and are designed to be flat at least in their end areas, spacing elements which are inserted between two respective adjacent flat tube end areas and are firmly connected with them, and in each case at least one connection duct along each transverse tube block side, wherein the tubes are sealed off on their ends and are provided with transverse openings in their two end areas, which transverse openings are in a connection-duct-forming connection with the spacing element transverse openings, and wherein at least one pair of separation spacing elements which are situated opposite one another in the same space between adjacent tubes is constructed in a closed manner without a continuous transverse opening and, as a result, on each transverse side of the tube block, at least two mutually separated connection ducts are formed for the separate flowing of plural fluids through pertaining tube block sections.

This heat transfer device of preferred embodiments of the invention has a construction which is comparatively easy to manufacture and consists of individual tubes which are situated in a spaced manner side-by-side and are sealed off on the end side, as well as of spacing elements which are inserted between two adjacent tube end areas respectively in order to form the desired spaces between the tubes. The required connection ducts on the transverse sides of the tube block are formed by respective transverse openings which are provided in the end areas of the tubes and in the spacing elements with the exception of the separation spacing elements. By the arranging of a pair of separation spacing elements which have no continuous transverse openings of this type and are situated opposite one another at the same level in the tube block, two or more mutually separated connection ducts are formed on each transverse side of the tube block in a manner which is simple with respect to the manufacturing technique. As a result, the tube block is divided into successive tube block sections through which several fluids can flow separately.

As a result, a heat transfer device having a compact construction is implemented at low manufacturing expenditures through which several fluids can flow in a respective mutually separate fashion. Such a heat transfer device can be used, for example, for the simultaneous cooling of engine oil, on the one hand, and of transmission oil, on the other hand, by means of air in a motor vehicle. In this case, only a single radiator block must be fastened in the vehicle which can easily be designed as a large-surface cooler.

In a further development of preferred embodiments of the invention, U-shaped spacing shoes are provided, each of which reaching around a pertaining tube end area, in which case adjacent spacing shoes are placed against one another in a contacting manner and are firmly connected with one another. In this fashion, the spacing elements which space adjacent tubes are formed of two mutually connected halves respectively of two successive spacing shoes. The separation spacing elements are implemented in that pertaining spacing shoe halves which are situated opposite one another at the same level are not provided with a continuous transverse opening. This construction of the heat transfer device very flexibly permits the entering of the separation spacing elements at any desired level of the tube block so that, with respect to its overall dimension, particularly the number of used tubes, as well as with respect to its division into the mutually fluid-separated tube block sections, during its manufacturing, the tube block can be optimally adapted to the respective application case without any large additional expenditures.

In the case of a further feature of especially preferred embodiments of the invention, the separation spacing elements have a different design on their exposed exterior side areas than the other spacing elements, specifically such that this can be detected by a corresponding sensor system. In this manner, it can be rapidly determined where the separation spacing elements are situated on the finished tube-block-type heat transfer device.

Other objects, advantages and novel features of the present invention will become apparent from the following detailed description of the invention when considered in conjunction with the accompanying drawings.

DETAILED DESCRIPTION OF THE DRAWINGS

Figure 1:
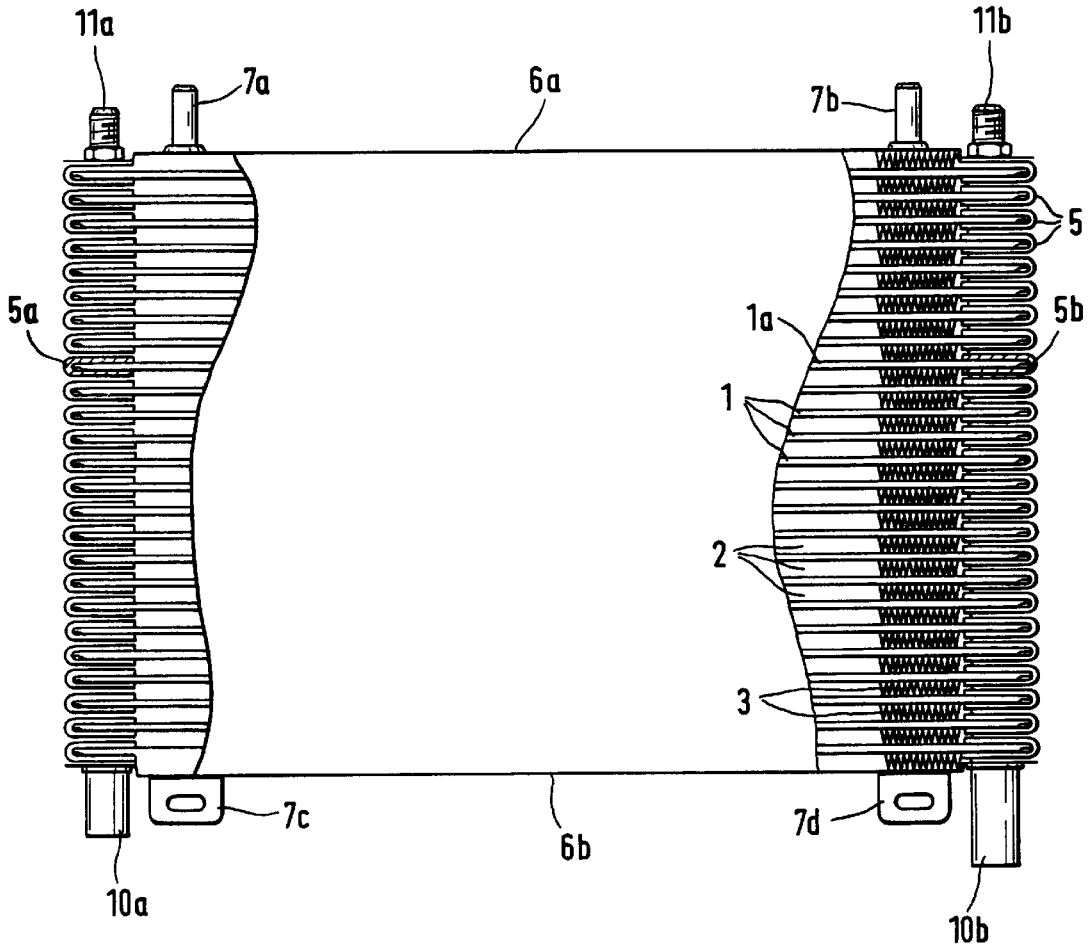
FIG. 1 is a schematic lateral view of a tube-block-type heat transfer device in a flat-tube construction which can be used as an oil/air cooler in a motor vehicle and through which two fluids can flow separately constructed according to a preferred embodiment of the present invention.

The tube-block-type heat transfer device illustrated in FIG. 1 contains a tube block consisting of several flat tubes 1 which are arranged in a row in the transverse direction of the tube side-by-side in a spaced manner. In the spaces 2 between the flat tubes 1, corrugated ribs 3 are mounted in a conventional manner which, for reasons of clarity, are only partially shown. The corrugated ribs 3 are used for the improved heat transfer between air, which is blown vertically with respect to the plane of the drawing of FIG. 1 through the spaces 2, and the fluid flowing in the flat tubes 1.

Figure 2:
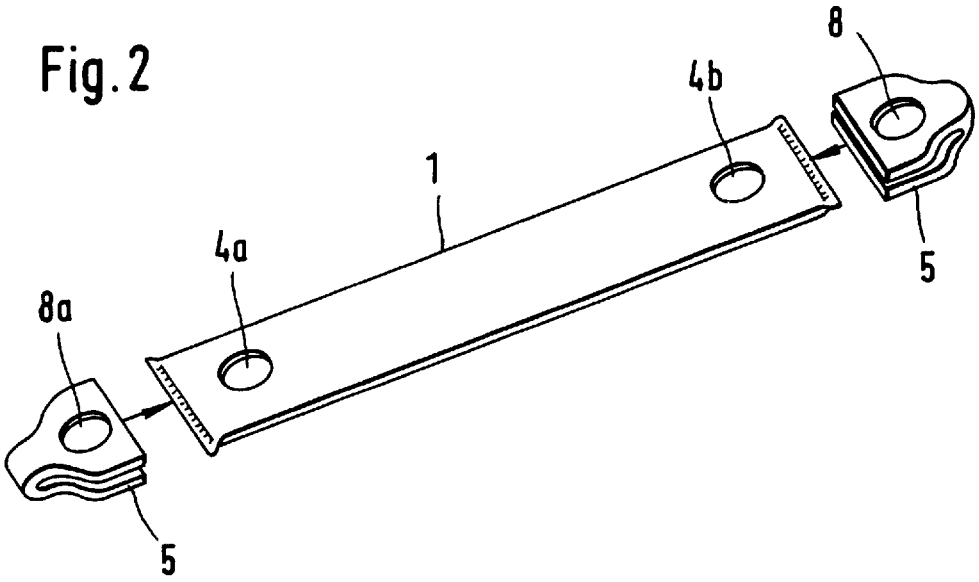
FIG. 2 is a perspective exploded view of a spacing shoe flat-tube element of the heat transfer device of FIG. 1.

As shown more clearly in conjunction with FIG. 2, each flat tube 1 is sealed off on its two ends; for example, by forming a flat fold and optionally by an additional sealing soldering. On both end areas, each flat tube 1 is provided with one continuous transverse opening 4*a*, 4*b* respectively. One U-shaped spacing shoe 5 respectively reaches around the tube end areas. As indicated by the arrows in FIG. 2, for manufacturing the heat transfer device, the two spacing shoes 5 are first placed on each flat tube 1 and then the thus obtained spacing shoe flat-tube units are placed against one another in a row so that adjacent spacing shoes 5 will contact one another. By soldering or by another suitable joining process, the spacing shoes 5 are then firmly connected with one another along their mutually contacting surfaces, in which case each spacing shoe 5 is fixedly connected with the reached-around tube end area so that a rigid tube block construction is obtained. This construction is closed off on the longitudinal side by one end plate element 6*a*, 6*b* respectively on which fastening elements 7*a*, 7*b*, 7*c*, 7*d* are provided by means of which the tube-block-type heat transfer device can be mounted at the desired mounting site.

For forming the connection ducts along the two transverse tube sides, the spacing shoes 5, with the exception of two special separation spacing shoes 5*a*, 5*b*, are provided on each of their two halves with one transverse opening 8 respectively. In the case of the finished tube block construction, the spacing shoe transverse openings 8 are aligned with one another on the respective transverse tube side and with the pertaining tube transverse openings 4*a*, 4*b*, whereby a respective connection duct is formed which is used as a distributor or collecting duct. In order to now make it possible that two different fluids flow separately through the tube block construction, instead of the above-described normal spacing shoes 5, a special pair of separation spacing shoes 5*a*, 5*b* is provided at a desired level of the tube block, as marked in a hatched manner in FIG. 1. This means that one 1*a* of the flat tubes is provided with these separation spacing shoes 5*a*, 5*b* instead of the normal spacing shoes 5.

Figure 3:
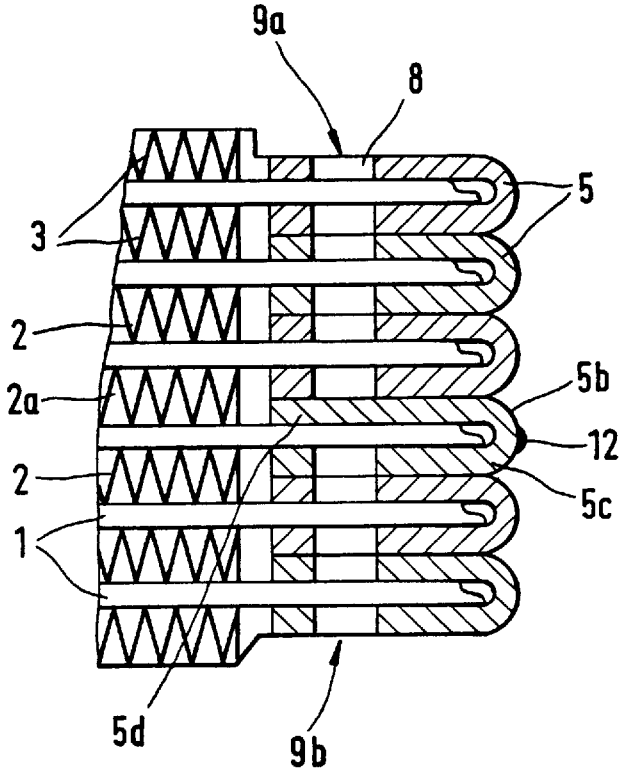
FIG. 3 is a cutout-type sectional view of a transverse side area of the heat transfer device of FIG. 1.

The separation spacing shoes 5*a*, 5*b* differ from the remaining spacing shoes 5 because of the fact that they are provided with a transverse opening only on one half 5*c* of their two halves 5*c*, 5*d*, while the other half 5*d* is constructed to be closed, as illustrated for one 5*b* of the two separation spacing shoes in the view of the detail of FIG. 3. In this case, the two closed halves 5*c* of the two separation spacing does 5*a*, 5*b* are situated within the same space 2*a* between two adjacent flat tubes. As a result, in a simple manner, a division is achieved of the connection duct structure on each transverse side of the tube into two separate connection ducts 9*a*, 9*b*, as partially shown in FIG. 3 for one transverse side of the tube.

By means of the two separation spacing shoes 5*a*, 5*b*, the tube block construction is therefore divided into two tube block sections with one distributor duct respectively on one transverse tube side and a pertaining collecting duct on the other transverse tube side, through which the two fluids can be guided in a mutually separated manner. As illustrated in FIG. 1, for each of the two tube sections, one connection 10*a*, 10*b*; 11*a*, 11*b* respectively is provided which leads to the outside, one of which, in each case operating as an inlet into the pertaining distributor duct and the other operating as the outlet from the pertaining collecting duct. For example, the heat transfer device of FIG. 1 can be used as a combined oil/air cooler for the simultaneously cooling of engine oil and transmission oil in that the engine oil to be cooled is guided through one of the two tube block sections separated from one another by the separation spacing shoes 5*a*, 5*b*, and the transmission oil to be cooled is guided through the other tube block section and cooling air can flow against the whole tube block construction.

As illustrated in FIG. 3, the spacing shoes 5, 5*a*, 5*b* determine the spacing of adjacent flat tubes 1 which is the result of the double thickness of a spacing shoe half. In order to be able to easily localize the separation spacing shoes 5*a*, 5*b* on the finished tube block, they carry a special marking 12 on the exterior side which is arranged at a point which remains free and can be detected, for example, visually by a corresponding sensor system. In this case, the marking may be designed such that it supplies information as to which the closed half 5*d* is of the separation spacing shoe 5*a*, 5*b*.

The division of the tube block construction into two fluid-separated tube block sections can also be achieved by alternative designs according to the invention. For example, two separation spacing shoes of the above-mentioned type can be provided which are situated opposite one another on the two transverse tube sides and which are arranged to be offset with respect to one another in the transverse tube direction by a spacing shoe in such a manner that their closed halves are situated in the same space between two adjacent flat tubes.

As another alternative, instead of the spacing shoes, spacing parts of a different type can be provided which provide the required spacing elements for the mutual spacing of the flat tubes. Thus, for example, perforated plate pieces can be inserted as spacing elements between the adjacent tube end areas and can be sealingly soldered or glued to these. In this case, one pair of unperforated plate pieces respectively must then be provided as separation spacing elements which carry out the function of the division of the tube block into fluid-separated sections.

If desired for certain requirements, several pairs of separation spacing elements which have the explained dividing function can also be provided in order to be able to separate the tube block into more than two fluid-separated sections and let a corresponding number of fluids flow through in a mutually separated manner. For the tube block sections which are not situated on the outside, a respective suitable inlet and outlet for the concerned distributor or collecting duct must then be laterally mounted.

In a further contemplated embodiment, it can be provided that the tubes are not sealed off on the end side by a folding but by the fact that the spacing shoes are fitted onto the flat tubes such that they reach into the tube by means of one half and are connected with it in a fluid-tight manner, for example, by means of a sealing soldering. In the finished tube block construction, on each transverse side, one spacing shoe half will then in each case alternate with a flat tube wall, in which case they are firmly connected with one another, for example, by means of soldering or gluing.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. Tube-block-type heat transfer device, having a tube block consisting of several tubes which are arranged in a row in the transverse direction side-by-side in a spaced manner and are designed to be flat at least in their end areas, spacing elements which are inserted between two respective adjacent flat tube end areas and are firmly connected with them, and in each case at least one connection duct along each transverse tube block side, wherein the tubes are sealed off on their ends and are provided with transverse openings in their two end areas, which transverse openings are in a connection-duct-forming connection with spacing element transverse openings, wherein at least one pair of separation spacing elements which are situated opposite one another in the same space between adjacent tubes is constructed in a closed manner without a continuous transverse opening and, as a result, on each transverse side of the tube block, at least two mutually separated connection ducts are formed for the separate flowing of plural fluids through pertaining tube block sections, and wherein the spacing elements associated with one tube end are connected together and are disposed at opposite sides of said one tube end with mutual contact of adjacent spacing elements between respective tubes.

2. Tube-block-type heat transfer device, having a tube block consisting of several tubes which are arranged in a row in the transverse direction side-by-side in a spaced manner and are designed to be flat at least in their end areas, spacing elements which are inserted between two respective adjacent flat tube end areas and are firmly connected with them, and in each case at least one connection duct along each transverse tube block side, wherein the tubes are sealed off on their ends and are provided with transverse openings in their two end areas, which transverse openings are in a connection-duct-forming connection with spacing element transverse openings, wherein at least one pair of separation spacing elements which are situated opposite one another in the same space between adjacent tubes is constructed in a closed manner without a continuous transverse opening and, as a result, on each transverse side of the tube block, at least two mutually separated connection ducts are formed for the separate flowing of plural fluids through pertaining tube block sections, and wherein the spacing elements are formed by mutually contacting halves of U-shaped spacing shoes which reach around the tube end areas, the separation spacing elements consisting of spacing shoes whose one half has a closed construction.

3. Tube-block-type heat transfer device, having a tube block consisting of several tubes which are arranged in a row in the transverse direction side-by-side in a spaced manner and are designed to be flat at least in their end areas, spacing elements which are inserted between two respective adjacent flat tube end areas and are firmly connected with them, and in each case at least one connection duct along each transverse tube block side, wherein the tubes are sealed off on their ends and are provided with transverse openings in their two end areas, which transverse openings are in a connection-duct-forming connection with spacing element transverse openings, wherein at least one pair of separation spacing elements which are situated opposite one another in the same space between adjacent tubes is constructed in a closed manner without a continuous transverse opening and, as a result, on each transverse side of the tube block, at least two mutually separated connection ducts are formed for the separate flowing of plural fluids through pertaining tube block sections, and wherein the separation spacing elements have on their exposed exterior side areas, a design which can be sensed and differs from that of the other spacing elements.

4. Tube-block-type heat transfer device according to claim 2, wherein the separation spacing elements have on their exposed exterior side areas, a design which can be sensed and differs from that of the other spacing elements.

5. A tube block heat transfer device comprising:

a plurality of tubes which are flattened in their end areas and arranged side by side and spaced from one another, spacing elements inserted between respective flattened end areas of said tubes, at least some of said tubes and said spacing elements having aligned connection duct forming openings to form respective fluidly connected tube block sections, and at least one pair of said spacing elements disposed at opposite ends of a fluid space between a pair of tubes being constructed in a closed manner without respective connection duct forming openings so that mutually separated tube block sections are provided which accommodate flowing of respective different fluids, and wherein the spacing elements associated with one tube end are connected together and are disposed at opposite sides of said one tube end with mutual contact of adjacent spacing elements between respective tubes.

6. A tube block heat transfer device comprising:

a plurality of tubes which are flattened in their end areas and arranged side by side and spaced from one another, spacing elements inserted between respective flattened end areas of said tubes, at least some of said tubes and said spacing elements having aligned connection duct forming openings to form respective fluidly connected tube block sections, and at least one pair of said spacing elements disposed at opposite ends of a fluid space between a pair of tubes being constructed in a closed manner without respective connection duct forming openings so that mutually separated tube block sections are provided which accommodate flowing of respective different fluids, wherein said spacing elements are respective U-shaped spacing shoes which contact respective opposite sides of a respective tube.

7. A heat transfer device according to claim 5, wherein said tubes and spacing elements are fixedly connected together.

8. A heat transfer device according to claim 6, wherein said tubes and spacing elements are fixedly connected together.

9. A heat transfer device according to claim 7, wherein said tubes and spacing elements are soldered together.

10. A heat transfer device according to claim 5, wherein said mutually separated tube block sections are configured to accommodate separate cooling of motor vehicle engine oil and motor vehicle transmission oil.

11. A method of making a tube block heat transfer device comprising:

arranging a plurality of tubes, which are flattened in their end areas, side by side and spaced from one another, inserting spacing elements between respective flattened end areas of said tubes, and fixedly connecting the tubes and spacing elements together, at least some of said tubes and said spacing elements having aligned connection duct forming openings to form respective fluidly connected tube block sections, and at least one pair of said spacing elements disposed at opposite ends of a fluid space between a pair of tubes being constructed in a closed manner without respective connection duct forming openings so that mutually separated tube block sections are provided which accommodate flowing of respective different fluids, wherein the spacing elements associated with one tube end are connected together and are disposed at opposite sides of said one tube end with mutual contact of adjacent spacing elements between respective tubes.

12. A method of making a tube block heat transfer device comprising:

arranging a plurality of tubes, which are flattened in their end areas, side by side and spaced from one another, inserting spacing elements between respective flattened end areas of said tubes, and fixedly connecting the tubes and spacing elements together, at least some of said tubes and said spacing elements having aligned connection duct forming openings to form respective fluidly connected tube block sections, and at least one pair of said spacing elements disposed at opposite ends of a fluid space between a pair of tubes being constructed in a closed manner without respective connection duct forming openings so that mutually separated tube block sections are provided which accommodate flowing of respective different fluids, wherein said spacing elements are respective U-shaped spacing shoes which contact respective opposite sides of a respective tube.

13. A method according to claim 11, wherein said tubes spacing elements are soldered together.

14. A method according to claim 12, wherein said tubes and spacing elements are soldered together.

15. A method according to claim 11, wherein said mutually separated tube block sections are configured to accommodate separate cooling of motor vehicle engine oil and motor vehicle transmission oil.

* * * * *